US011958509B2

(12) United States Patent
Heider et al.

(10) Patent No.: US 11,958,509 B2
(45) Date of Patent: Apr. 16, 2024

(54) HOPPER RAILCAR WITH DOOR DEFLECTOR FOR TRANSVERSE PIVOTED OUTLET GATE, DOOR DEFLECTOR AND METHOD OF RETROFITTING HOPPER RAILCAR TO INCLUDE DOOR DEFLECTOR FOR TRANSVERSE PIVOTED OUTLET GATE

(71) Applicant: JAC Operations, Inc., Chicago, IL (US)

(72) Inventors: Michael Heider, Johnstown, PA (US); Michael Selapack, Portage, PA (US)

(73) Assignee: JAC OPERATIONS, INC., Chicago, IL (US)

( * ) Notice: Subject to any disclaimer, the term of this patent is extended or adjusted under 35 U.S.C. 154(b) by 0 days.

(21) Appl. No.: 18/110,909

(22) Filed: Feb. 17, 2023

(65) Prior Publication Data

US 2023/0192156 A1 Jun. 22, 2023

Related U.S. Application Data

(63) Continuation of application No. 16/827,132, filed on Mar. 23, 2020, now abandoned.

(60) Provisional application No. 62/822,233, filed on Mar. 22, 2019.

(51) Int. Cl.

| | |
|---|---|
| ***B61D 7/32*** | (2006.01) |
| ***B61D 7/02*** | (2006.01) |
| ***B61D 7/18*** | (2006.01) |

(52) U.S. Cl.

CPC ..... *B61D 7/32* (2013.01); *B61D 7/02* (2013.01); *B61D 7/18* (2013.01)

(58) Field of Classification Search

CPC ... B61D 7/32; B61D 7/02; B61D 7/18; B61D 7/16; B61D 7/26; B61D 7/24

See application file for complete search history.

(56) References Cited

U.S. PATENT DOCUMENTS

| | | | |
|---|---|---|---|
| 144,966 | A | 11/1873 | Elliott et al. |
| 147,341 | A | 2/1874 | Meyer |
| 162,189 | A | 4/1875 | Pierce |
| 217,289 | A | 7/1879 | Kane |
| 347,523 | A | 8/1886 | Scully |
| 349,134 | A | 9/1886 | Barr |
| 369,102 | A | 8/1887 | Davis |
| 500,846 | A | 7/1893 | Blackstone |
| 528,279 | A | 10/1894 | Roberts |
| 568,775 | A | 10/1896 | Lane |
| 658,783 | A | 10/1900 | King |

(Continued)

*Primary Examiner* — Scott A Browne

(74) *Attorney, Agent, or Firm* — Blynn L. Shideler; Krisanne Shideler; BLK Law Group

(57) ABSTRACT

A hopper railcar includes a plurality of hoppers for carrying material laden material, wherein each hopper has a lower discharge chute formed by converging side sheets and end sheets defining a transverse opening; and pivoted transverse door for each transverse opening for selectively opening and closing and closed by a pivoted door, the pivoted door having a pivot axis perpendicular to a longitudinal length of the railcar, and lateral deflectors on lateral sides of the doors with each of the deflectors having a side face extending above an interior facing surface of the doors upon which laden flows with the door in the open position. A method of retrofitting hopper railcars to include deflectors is also disclosed.

20 Claims, 2 Drawing Sheets

(56) References Cited

U.S. PATENT DOCUMENTS

| | | | | |
|---|---|---|---|---|
| 699,820 | A | 5/1902 | Sage | |
| 743,501 | A | 11/1903 | Hansen | |
| 763,186 | A | 6/1904 | Johnson | |
| 797,341 | A | 8/1905 | Brown | |
| 881,884 | A | 3/1908 | Dodds | |
| 891,325 | A | 6/1908 | Butchart | |
| 914,242 | A | 3/1909 | Campbell | |
| 937,419 | A | 10/1909 | Campbell | |
| 1,182,642 | A | 5/1916 | Clark | |
| 1,300,959 | A | 4/1919 | Hart | |
| 1,418,907 | A | 6/1922 | Campbel | |
| 1,444,730 | A | 2/1923 | Christianson | |
| 2,079,862 | A | 5/1937 | Kiesel, Jr. | |
| 2,720,173 | A | 10/1955 | Dorey | |
| 3,080,829 | A | 3/1963 | Damy | |
| 3,104,623 | A | 9/1963 | Dorey | |
| 3,187,684 | A | 6/1965 | Ortner | |
| 3,242,878 | A | 3/1966 | Floehr | |
| 3,256,836 | A | 6/1966 | Floehr | |
| 3,348,501 | A | 10/1967 | Stevens et al. | |
| 3,509,827 | A | 5/1970 | Sutter | |
| 3,577,932 | A | 5/1971 | Pulcrano et al. | |
| 3,614,932 | A | 10/1971 | Damy | |
| 4,228,742 | A | 10/1980 | Przybylinski et al. | |
| 4,292,898 | A | 10/1981 | Gordon et al. | |
| 4,361,096 | A | 11/1982 | Funk | |
| 4,366,757 | A * | 1/1983 | Funk | B61D 7/18 414/388 |
| 4,376,542 | A | 3/1983 | Hennessy | |
| 4,644,871 | A | 2/1987 | Arrey et al. | |
| 4,884,511 | A | 12/1989 | Hallam et al. | |
| 5,070,793 | A | 12/1991 | Kurtz et al. | |
| 5,249,531 | A | 10/1993 | Taylor | |
| 5,417,165 | A | 5/1995 | Peppin et al. | |
| 5,934,200 | A | 8/1999 | Lydic | |
| 6,334,397 | B1 | 1/2002 | Valgora | |
| 6,405,658 | B1 | 6/2002 | Taylor | |
| 6,955,127 | B2 | 10/2005 | Taylor | |
| 7,080,599 | B2 | 7/2006 | Taylor | |
| 7,703,397 | B2 * | 4/2010 | Forbes | B61D 7/02 105/282.2 |
| 8,640,631 | B2 * | 2/2014 | Josephson | B61D 7/02 105/247 |
| 9,272,717 | B2 * | 3/2016 | Forbes | B61D 7/22 |
| 9,914,464 | B1 * | 3/2018 | Taylor | B61D 7/22 |
| 2006/0254456 | A1 | 11/2006 | Taylor | |
| 2009/0007813 | A1 | 1/2009 | Early | |
| 2010/0251923 | A1 * | 10/2010 | Forbes | B61D 7/26 105/247 |
| 2020/0298895 | A1 | 9/2020 | Edwards et al. | |

* cited by examiner

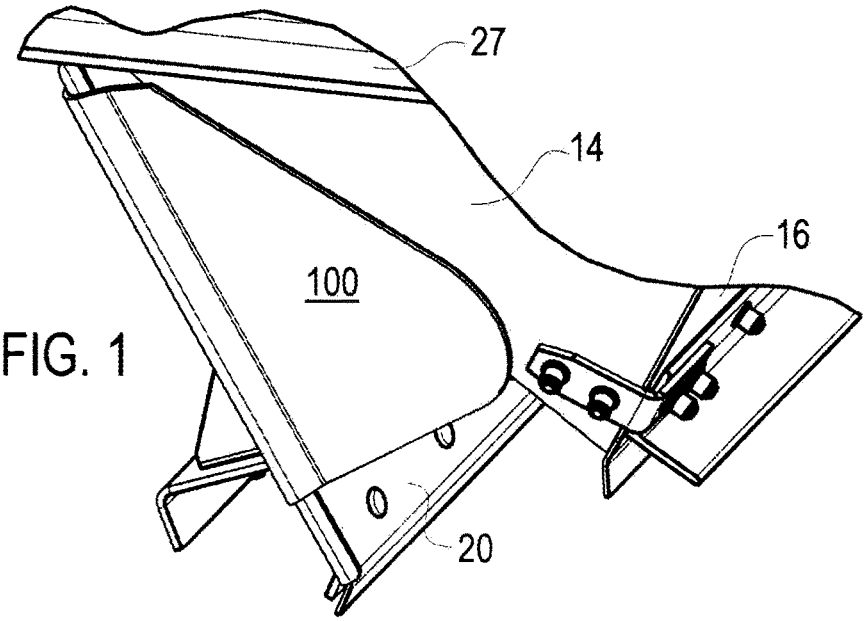
FIG. 1
FIG. 2
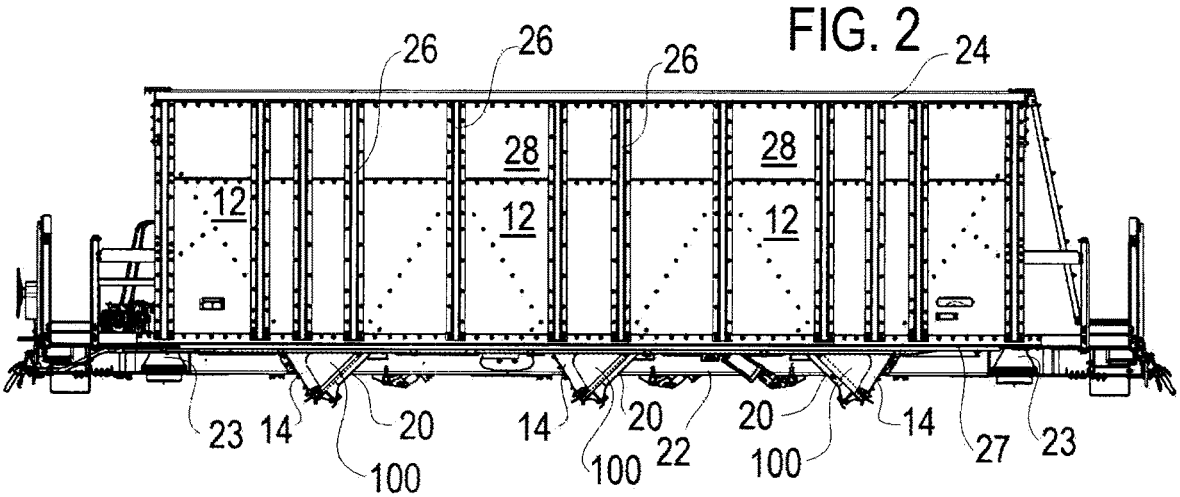
FIG. 3
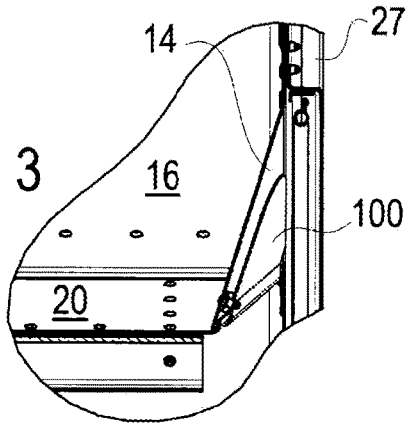

FIG. 4
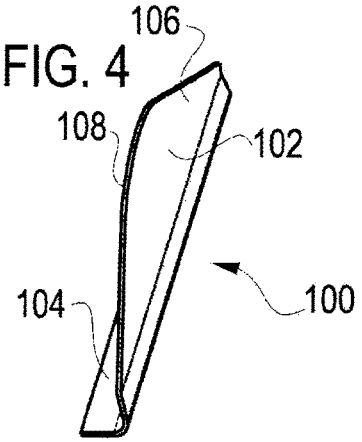
FIG. 5
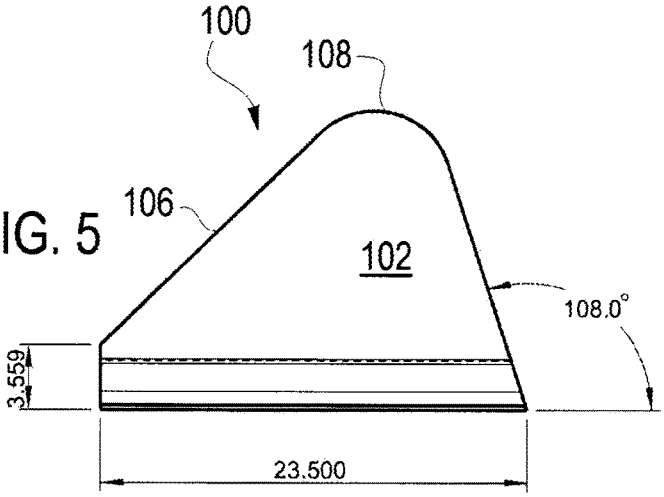
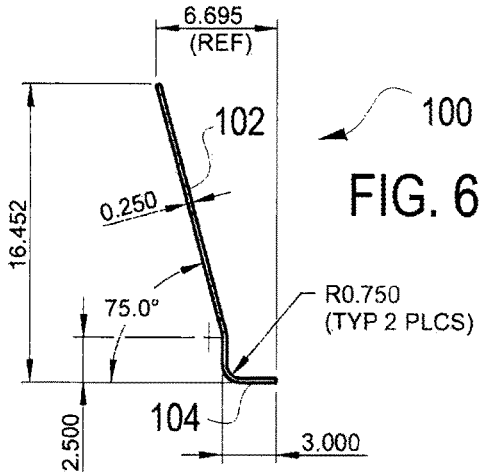
FIG. 6
FIG. 7
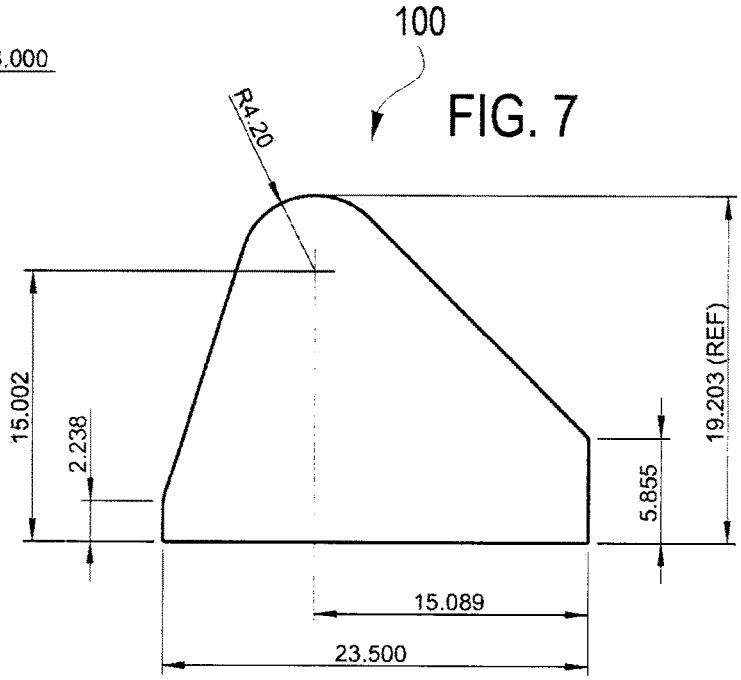

HOPPER RAILCAR WITH DOOR DEFLECTOR FOR TRANSVERSE PIVOTED OUTLET GATE, DOOR DEFLECTOR AND METHOD OF RETROFITTING HOPPER RAILCAR TO INCLUDE DOOR DEFLECTOR FOR TRANSVERSE PIVOTED OUTLET GATE

BACKGROUND OF THE INVENTION

1. Field of the Invention

The present invention relates to a hopper railcar with door deflector for transverse pivoted outlet gate, door deflector and method of retrofitting hopper railcar to include door deflector for transverse pivoted outlet gate.

2. BACKGROUND INFORMATION

A hopper railcar, or hopper car, is a railcar used to transport loose bulk commodities such as grain, coal, minerals, fertilizers, cement, etc. The terms railcar and car are used interchangeably herein. The hopper car interior is typically divided into pockets or hoppers with doors on the bottom of each pocket to empty cargo by the force of gravity, making for quick and effective unloading. The discharge doors do not prevent the use of a rotary unloader that pivots the entire car, but the discharge doors on the bottom do not require the use of such a rotary unloader.

Further the hopper railcars may be closed hopper railcars or open top railcars. Open top hopper railcars may include removable covers which can be used for transport and other specialized tops could be used with a hopper railcar depending upon the intended cargo.

U.S. Pat. Nos. 144,966; 147,341, 162,189; 217,289; 347, 523; 349,134, 369,102; 500,846; 528,279; and 568,775 from about 1873-1889 disclose early hopper railcar designs, which is helpful to illustrate the basic hopper concepts and to demonstrate hopper car evolution.

U.S. Pat. No. 658,783 discloses early hopper railcar construction with the body formed of metal sheets coupled together. U.S. Pat. No. 699,820 discloses a general hopper car and specifically a door operating mechanism for a hopper car, also called a "dumping car" therein. U.S. Pat. No. 743,501 discloses a hopper car and specifically an ore carrying car design. U.S. Pat. No. 763,186 discloses a general hopper car and specifically a door operating mechanism for a hopper car, also called a "dumping car" therein. U.S. Pat. No. 797,341 discloses a reinforced central hopper type hopper car. U.S. Pat. No. 881,884 discloses a general hopper car and specifically a door operating mechanism for a hopper car, also called a "dumping car" therein. U.S. Pat. No. 891,325 discloses a general hopper car and specifically a hopper lining for an ore car. U.S. Pat. No. 914,242 discloses a general hopper car also called a "dump car" therein. U.S. Pat. No. 937,419 discloses a general hopper car also called a "dump car" therein U.S. Pat. No. 1,182,642 discloses a general hopper car also called a "dump car" therein. U.S. Pat. No. 1,300,959 discloses a general hopper car also called a "hopper dump car" therein, which shows the early versions of multiple hoppers and distinct transverse doors for the individual hoppers, which is most common today and the subject of the present invention.

U.S. Pat. No. 1,418,907 discloses a general hopper car and specifically a door operating mechanism for a hopper car, also called a "dump car" therein. U.S. Pat. No. 1,444, 730 discloses a general hopper car and specifically a door operating mechanism for a hopper car, also called a "hopper bottom" therein.

U.S. Pat. No. 2,079,862 discloses a general hopper car and specifically a center-sill design for use therein.

U.S. Pat. No. 3,080,829 discloses a ballast hopper car and specifically a ballast distributing hopper car. U.S. Pat. No. 3,104,623 discloses a general hopper car and specifically a door locking structure for a hopper railcar. U.S. Pat. No. 3,187,684 discloses a general hopper car and specifically a door opening system for a hopper railcar. U.S. Pat. No. 3,242,878 discloses a "shallow" hopper car design. U.S. Pat. No. 3,256,836 discloses a general hopper car and specifically a door opening system for a hopper railcar. U.S. Pat. No. 3,348,501 discloses a general hopper car and specifically a sliding door opening system for a hopper railcar. U.S. Pat. No. 3,509,827 discloses an aluminum body hopper car. U.S. Pat. No. 3,577,932 discloses a hopper car and specifically a door opening system for a hopper railcar.

U.S. Pat. No. 4,228,742 discloses a hopper car, also called a "vehicle hopper" therein, having longitudinally spaced hopper end slope sheets and hopper cross ridge slope sheets formed prior to assembly. U.S. Pat. No. 4,292,898 discloses a hopper car including an elongated, load bearing body having walls formed of a specified fiber reinforced plastic resin composite of glass reinforcing filaments and a structural "organo-polymeric" resin. U.S. Pat. No. 4,361,096 discloses a hopper car including seals to prevent seepage of a fine granular commodity between the hopper doors and the adjacent hopper sheets of a railroad hopper car of the type having opposed pairs of hopper doors swingable between a closed position and a downwardly depending open position. U.S. Pat. No. 4,366,757 discloses a hopper railcar apparatus for actuating and locking each pair of hopper doors of a railroad hopper car of the type having a plurality of hopper doors arranged in opposed pairs and extending transversely of the hopper car center sill. U.S. Pat. No. 4,376,542 discloses a gasket structure for application to a hopper car door edge. U.S. Pat. No. 4,644,871 discloses an articulated hopper railcar with a designated "short distance" between truck centers. U.S. Pat. No. 4,884,511 discloses an aluminum body hopper railcar with having a center sill hood which uses aluminum collar castings.

U.S. Pat. No. 5,070,793 discloses a sidewall and top chord member for an open top gondola or hopper railway car. U.S. Pat. No. 5,249,531 discloses actuating system for operating the doors of a railroad hopper car. U.S. Pat. No. 5,417,165 discloses a railroad hopper ballast discharge door assembly includes pliant side panels along a discharge gate opening. The pliant side panels are strong enough to retain the ballast within the hopper when the door is closed, yet are flexible enough to yield when ballast flowing out of the hopper becomes wedged between the side panel and the door as the door closes. U.S. Pat. No. 5,934,200, developed by the Freightcar America, Inc., discloses a lightweight hopper-type rail car designed to minimize aerodynamic drag and including a cross ridge arrangement to increase the fabrication efficiency of the car.

U.S. Pat. No. 6,334,397 discloses side sheet construction for a hopper railcar, also called a bulk container car, side sheet assembly for a rail car having a pair of horizontally extending upper and lower side sheets form with a plurality of longitudinally extending strengthening ribs. The upper and lower side sheets are affixed to each other at a horizontal seam to either form flat connection or a rib at the horizontal seam. U.S. Pat. No. 6,405,658 discloses a manual discharge door operating system for a hopper railcar which is provided with an over-center closed position to hold the door in the closed position. U.S. Pat. No. 6,955,127 discloses actuating system for manually operating the doors of a railroad hopper car.

U.S. Pat. No. 7,080,599 discloses an actuating system for operating transverse doors of a railroad hopper car which close in an over center position.

U.S. Patent 9,272,717 teaches a wing structure (see elements 490 and 492) that are designed such that with the door closed they may "be squeezed between the sidewall members 464 and 468 in a spring loaded interference fit. The spring loading may tend to bias margins 494 to ride against the adjacent surfaces of the sidewall members, in such a manner as to form a locus of contact, such as might be termed a seal, such as may tend to impede passage of aggregate lading therepast." This inner seal structure limits the retrofitting of this design and can limit the life of the wing structure which will undergo a continuous flexing with each closing and opening of the door.

U.S. Patent Publication 2006/0254456 discloses a general hopper railcar and a transverse door operating system with an over-center door locking or closed position. U.S. Patent Publication 2008/0066642 discloses a general hopper railcar with a seal member assembly that is mounted to one or both of the closure members. U.S. Patent Publication 2009/0007813 discloses a general hopper railcar with opposed double doors for discharging cargo from a hopper car.

The above listed patents and publications are representative of the state of the art of hopper railcars and these patents and published applications are incorporated by reference herein in their entireties.

In hopper cars with transverse pivoted outlet gates there has been an issue at select unloading locations, also known as pits. The issue is that as the laden material flows out of the open gate some of this material has a transverse trajectory and will end up on the weigh-side walkway. The material on the walkway represents a slipping hazard. In addressing this issue, operators have utilized a worker on each side of the railcar to manually sweep the material on the walkway into the pit after each car unloading, representing a labor intensive unloading solution. There is a need for transverse pivoted outlet gates of hopper cars to direct substantially all of the laden material directly into the desired unloading location or pit.

SUMMARY OF THE INVENTION

It is an object of the present invention to provide a hopper railcar with door deflector for transverse pivoted outlet gate, door deflector therefore and method of retrofitting hopper railcar to include door deflector for transverse pivoted outlet gate whereby the transverse pivoted outlet gates direct substantially all of the laden material directly into the desired unloading location or pit.

One aspect of the present invention provides a hopper railcar including a plurality of hoppers for carrying material laden material, wherein each hopper has a lower discharge chute formed by converging side sheets and end sheets defining a transverse opening; and pivoted transverse door for each transverse opening for selectively opening and closing and closed by a pivoted door, the pivoted door having a pivot axis perpendicular to a longitudinal length of the railcar, and lateral deflectors on lateral sides of the doors with each of the deflectors having a side face extending above an interior facing surface of the doors upon which laden flows with the door in the open position.

The hopper railcar according to the invention may provide wherein the face of each deflector is angled laterally away from the interior facing surface of the doors. The hopper railcar according to the invention may provide wherein the face of each deflector is angled laterally away from the interior facing surface of the doors between 65 and 85 degrees, such as 75 degrees. The hopper railcar according to invention may provide wherein a top edge of each deflector moves from a position closer to the interior facing surface of the doors near the pivot axis than at an apex which is further from the pivot axis. The hopper railcar according to the invention may provide wherein each deflector includes a mounting base parallel to the door. The hopper railcar according to the invention may provide wherein the top edge of each deflector is over four times the distance from the mounting base at the apex than at an end closet to the pivot axis. The hopper railcar according to the invention may provide wherein with each door in the closed position the side face of each deflectors is adjacent the side sheets.

One aspect of the present invention provides a method of retrofitting a hopper railcar comprising the steps of: Providing a hopper railcar having a plurality of hoppers for carrying material laden material, wherein each hopper has a lower discharge chute formed by converging side sheets and end sheets defining a transverse opening, and a pivoted transverse door for each transverse opening for selectively opening and closing and closed by a pivoted door, the pivoted door having a pivot axis perpendicular to a longitudinal length of the railcar; and Coupling lateral deflectors on lateral sides of the doors with each of the deflectors having a side face extending above an interior facing surface of the doors upon which laden flows with the door in the open position.

One aspect of the present invention provides lateral deflectors for a pivoted transverse door of a hopper railcar configured for attachment on lateral sides of the doors with each of deflectors having a mounting base configured to be mounted parallel to the door and a side face configured to extend above an interior facing surface of the doors upon which laden flows with the door in the open position.

These and other advantages of the present invention will be clarified in the brief description of the preferred embodiment taken together with the drawings in which like reference numerals represent like elements throughout.

BRIEF DESCRIPTION OF THE DRAWINGS

FIG. 1 is a perspective view of a hopper railcar with door deflector for transverse pivoted outlet gate according to the one embodiment of the present invention.

FIG. 2 is a side elevational view of the of the hopper railcar according to FIG. 1.

FIG. 3 is a bottom partial section view through an outlet gate of the hopper railcar according to FIG. 2.

FIG. 4 is a perspective top view of the deflector for an outlet gate of a hopper railcar according to the one embodiment of the present invention.

FIG. 5 is a side elevational view of the deflector for an outlet gate of a hopper railcar according to FIG. 4.

FIG. 6 is a front elevational view of the deflector for an outlet gate of a hopper railcar according to FIG. 4.

FIG. 7 is a side elevational view of a flat pattern for forming the deflector for an outlet gate of a hopper railcar according to FIG. 4.

DESCRIPTION OF THE PREFERRED EMBODIMENTS

The present invention provides a hopper railcar 10 typically divided into a plurality of hoppers 12 for carrying material laden material. Each hopper 12 has a lower discharge chute formed by converging side sheets 14 and end sheets 16 defining a transverse opening that is selectively opened and closed by a pivoted door 20.

Each railcar 10 includes a number of conventional features that need not be described herein in detail as they are well known in the art, including an under frame structure with a center sill 22 running the length of the railcar 10 and wherein the underframe is supported a pair of spaced trucks. Bolsters 23 are configured to be above truck assemblies and coupled to the center sill. The railcar 10 includes couplers for connecting adjacent cars 10, top chord 24, side stakes 26, upper side sheets 28 extending to the top chord 24 and a side sill 27. The upper side sheets 28 may be, for example, aluminum sheets or plates as may be the lower side sheets and end sheets. The upper sheets 28 are attached to respective side stakes 26 and top chord 24 in a conventional fashion.

The interior of the railcar 10 may further include bracing structures, such as "k bracing" format, including cross members extending between the sides and diagonal members extending to the center of the railcar 10. Bracing is also believed to be generally known to those in the art and may, or may not be present.

The present invention is directed to pivoted transverse doors 20 of hopper railcars 10. The door operating mechanism and closing and latching mechanism is not described herein and a number of systems may be used, including pneumatic and mechanical systems operating a single door or several doors 20 in tandem. Transverse doors 20 extend across the railcar 10, as opposed to longitudinal doors, and thus have a pivot axis perpendicular to the center sill 22. The present invention is directed to addressing a need for transverse pivoted outlet gates of hopper cars to direct substantially all of the laden material directly into the desired unloading location or pit. The present invention provides lateral deflectors 100 on the lateral sides of the doors 20 with the deflectors 100 having a side face 102 extending above an interior facing surface of the doors 20 upon which laden flows.

The deflectors 100 of the present invention may be formed form plate material such as a 24"×20" piece of 0.25" steel (ASTM A-572 GR 50). Other sizes and grades are possible. After cut into the flat pattern shown in FIG. 7, the deflector 100 can be bent into the configuration shown using hydraulic press brakes or other known bending methods.

The deflectors 100 may be referenced as lateral deflectors 100 for a pivoted transverse door 20 of a hopper railcar 10 as they are configured for attachment on lateral sides of the doors 20. Each of deflector 100 has a mounting base 104 configured to be mounted parallel to the door 20 with the side face 102 configured to extend above an interior facing surface of the doors 20 upon which laden flows with the door in the open position.

The base 104 may be 3" wide with a radius end. The base 104 may be welded to the door 20 or mechanical fasteners may be used, or a combination of welding and mechanical fasteners.

At a position about 2½" above the base 104 the side face 102 of each deflector 100 is angled laterally away from the mounting base 104. The side face 102 of each deflector 100 is angled laterally away from the mounting base 104 between 65 and 85 degrees, namely about 75 degrees. This angle accommodates the converging side sheets 14 of the hopper 12 whereby with each door 20 in the closed position on the hopper 12 the side face 102 of each deflector 100 is configured to be adjacent side sheets 14.

Each lateral deflector is increasing in relative height along the door 20, wherein a top edge 106 of each deflector 100 moves or extends from a position closer to the mounting base 104 at one end (3.559") than at an apex 108 (16.452"). Thus the top edge 106 of each deflector 100 is at least three times and generally more than four times the distance from the mounting base 104 at the apex 108 than at one end. The distal edge of the deflector 100 that is farthest from the pivot extends at an angle of about 108 degrees from the apex 108 to the mounting base 104.

The hopper railcar 10 of the present invention provides through the deflectors 100 that the transverse pivoted outlet gates 20 direct substantially all of the laden material directly into the desired unloading location or pit. This avoids the need for workers on both sides of the car to address excess laden on the walkway.

Further the Lateral deflectors 100 for a pivoted transverse door 20 of a hopper railcar 10 according to the present invention are easily retrofitted onto existing transverse door hopper railcars. Mainly the angle of the face 102 should accommodate the angle of the side sheets of the railcar. The face 102 may be adjusted (i.e. notched out as needed) to accommodate other components on existing cars, but the profile as shown suggests wide applicability to existing door designs with no further modification.

The method of retrofitting a hopper railcar comprises the steps of: Providing a hopper railcar having a plurality of hoppers for carrying material laden material, wherein each hopper has a lower discharge chute formed by converging side sheets and end sheets defining a transverse opening, and a pivoted transverse door for each transverse opening for selectively opening and closing and closed by a pivoted door, the pivoted door having a pivot axis perpendicular to a longitudinal length of the railcar; and Coupling lateral deflectors 100 on lateral sides of the doors with each of the deflectors having a side face 102 extending above an interior facing surface of the doors upon which laden flows with the door in the open position. The coupling may be welding or fasteners (bolts) of the mounting base 104 to the associated door.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention should be defined by the appended claims and equivalents thereto.

What is claimed is:

1. A hopper railcar comprising:

a plurality of hoppers for carrying laden material, wherein each hopper has a lower discharge chute formed by converging side sheets and end sheets defining a hopper opening; and a pivoted door for each hopper opening for selectively opening and closing the hopper opening, the pivoted door having a pivot axis perpendicular to a longitudinal length of the railcar, and a pair of one piece lateral deflectors on and coupled to lateral sides of each pivoted door with each of the lateral deflectors having a side face extending above an interior facing surface of a pivoted door to which the lateral deflector is coupled, and wherein laden material flows upon the interior facing surface with the pivoted door to which the lateral deflector is coupled is in an open position, wherein each lateral deflector includes a mounting base parallel to the pivoted door to which the lateral deflector is coupled and wherein the mounting base extends along an exterior facing surface of the pivoted door to which the lateral deflector is coupled which is opposite the interior facing surface for coupling the lateral deflector to the pivoted door with the mounting base having a radius end curving around the lateral side of the pivoted door and wherein the side face of each lateral deflector extends from the radius end of the mounting base and at a position above the mounting base is angled laterally away from the mounting base and from the interior facing surface of the pivoted door to which the lateral deflector is coupled, and wherein with each pivoted door in the closed position a side face of each of the deflectors coupled to the pivoted door is adjacent an outer surface of one of the converging side sheets and not extending through the hopper opening.

2. The hopper railcar according to claim 1, wherein the side face of each lateral deflector is angled, at a position above the mounting base, laterally away from the mounting base between 65 and 85 degrees.

3. The hopper railcar according to claim 2, wherein a top edge of each deflector is at a position closer to the interior facing surface of the pivoted door to which the lateral deflector is coupled near the pivot axis than at an apex of the top edge of each deflector.

4. The hopper railcar according to claim 3, wherein the top edge of each deflector is over four times the distance from the mounting base at the apex than at an end closest to the pivot axis.

5. The hopper railcar according to claim 1, wherein a top edge of each deflector is at a position closer to the interior facing surface of the pivoted door to which the lateral deflector is coupled near the pivot axis than at an apex of the top edge of each deflector.

6. The hopper railcar according to claim 5, wherein the top edge of each deflector is over four times the distance from the mounting base at the apex than at an end closest to the pivot axis.

7. The hopper railcar according to claim 6, wherein each deflector is formed of steel plate material.

8. A method of retrofitting a hopper railcar comprising the steps of:

providing a hopper railcar having a plurality of hoppers for carrying laden material, wherein each hopper has a lower discharge chute formed by converging side sheets and end sheets defining a hopper opening, and a pivoted door for each hopper opening for selectively opening and closing the hopper opening, the pivoted door having a pivot axis perpendicular to a longitudinal length of the railcar and the pivoted door having an interior facing surface upon which laden flows with the pivoted door in an open position and an exterior facing surface opposite the interior facing surface; and coupling lateral deflectors on lateral sides of each of the pivoted doors with each of the deflectors having a side face extending above the interior facing surface of the pivoted door to which the lateral deflectors are coupled, wherein each lateral deflector includes a mounting base parallel to the pivoted door to which the lateral deflector is coupled and wherein the mounting base extends along the exterior facing surface of the pivoted door to which the lateral deflector is coupled with the mounting base having a radius end curving around the lateral side of the pivoted door and wherein the side face of each lateral deflector extends from the radius end of the mounting base and at a position above the mounting base is angled laterally away from the mounting base and from the interior facing surface of the pivoted door to which the lateral deflector is coupled, and wherein with each pivoted door in the closed position a side face of each of the deflectors coupled to the pivoted door is adjacent an outer surface of one of the converging side sheets and not extending through the hopper opening.

9. The method of retrofitting a hopper railcar according to claim 8, wherein the side face of each lateral deflector is angled, at a position above the mounting base, laterally away from the mounting base between 65 and 85 degrees.

10. The method of retrofitting a hopper railcar according to claim 9, wherein a top edge of each deflector is at a position closer to the interior facing surface of the pivoted door to which the lateral deflector is coupled near the pivot axis than at an apex of the pivoted door to which the lateral deflector is coupled.

11. The method of retrofitting a hopper railcar according to claim 10, wherein the top edge of each lateral deflector is over four times the distance from the mounting base at the apex than at an end closest to the pivot axis.

12. The method of retrofitting a hopper railcar according to claim 11, wherein each deflector is formed of steel plate material.

13. The method of retrofitting a hopper railcar according to claim 8, wherein a top edge of each deflector is at a position closer to the interior facing surface of the pivoted door to which the lateral deflector is coupled near the pivot axis than at an apex of the pivoted door to which the lateral deflector is coupled.

14. The method of retrofitting a hopper railcar according to claim 13, wherein the top edge of each lateral deflector is over four times the distance from the mounting base at the apex than at an end closest to the pivot axis.

15. The method of retrofitting a hopper railcar according to claim 14, wherein each deflector is formed of steel plate material.

16. Lateral deflectors for a pivoted transverse door of a hopper railcar configured for attachment on lateral sides of the pivoted transverse door with each of the lateral deflectors having a mounting base configured to be mounted parallel to the pivoted transverse door and a side face configured to extend above an interior facing surface of the pivoted transverse door upon which laden flows with the pivoted transverse door in an open position, wherein each lateral deflector includes a mounting base parallel to the pivoted door to which the lateral deflector is coupled with a radius end configured to curve around the lateral side of the pivoted door and wherein the side face of each lateral deflector extends from the radius end of the mounting base and at a position above the mounting base is angled laterally away from the mounting base and from the interior facing surface of the pivoted door to which the lateral deflector is coupled between 65 and 85 degrees, and wherein with each pivoted door in the closed position a side face of each of the deflectors coupled to the pivoted door is configured to be adjacent an outer surface of one of a pair converging side sheets and not extending through a hopper opening.

17. The lateral deflectors according to claim 16, wherein a top edge of each lateral deflector is at a position closer to the mounting base at one end than at an apex of the top edge.

18. The lateral deflectors according to claim 17, wherein the top edge of each deflector is over four times the distance from the mounting at the apex than at an end closest to the pivot axis.

19. The lateral deflectors according to claim 18, wherein each deflector is formed of steel plate material.

20. The lateral deflectors according to claim 16, wherein the side face of each lateral deflector is angled, at a position above the mounting base, laterally away from the mounting base about 75 degrees.

* * * * *